United States Patent [19]

Puttock

[11] Patent Number: 4,957,046

[45] Date of Patent: Sep. 18, 1990

[54] PROJECTILE

[75] Inventor: Michael C. Puttock, Ashford, England

[73] Assignee: Thorn EMI Electronics Limited, Hayes, England

[21] Appl. No.: 274,374

[22] Filed: Nov. 22, 1988

[30] Foreign Application Priority Data

Dec. 12, 1987 [GB] United Kingdom ..... 8729073

[51] Int. Cl.[5] ..... F42B 13/50

[52] U.S. Cl. ..... 102/489; 102/480; 102/703

[58] Field of Search ..... 102/351, 357, 388, 393, 102/473, 480, 489, 703

[56] References Cited

U.S. PATENT DOCUMENTS

| | | | |
|---|---|---|---|
| 3,599,568 | 8/1971 | Shellnutt et al. . | |
| 3,722,414 | 3/1973 | Talley . | |
| 3,954,060 | 5/1976 | Haag et al. | 102/703 |
| 4,036,140 | 7/1977 | Korr et al. | 102/703 |
| 4,211,169 | 7/1980 | Brothers . | |
| 4,372,216 | 2/1983 | Pinson et al. . | |
| 4,455,943 | 6/1984 | Pinson | 102/489 |
| 4,625,646 | 12/1986 | Pinson | 102/489 |
| 4,638,737 | 1/1987 | McIngvale | 102/489 |

FOREIGN PATENT DOCUMENTS

| | | | |
|---|---|---|---|
| 114901 | 8/1984 | European Pat. Off. . | |
| 275694 | 1/1914 | Fed. Rep. of Germany | 102/480 |
| 2909326 | 9/1980 | Fed. Rep. of Germany | 102/480 |
| 469153 | 7/1937 | United Kingdom . | |

*Primary Examiner*—Charles T. Jordan
*Assistant Examiner*—Rochelle Ueberman
*Attorney, Agent, or Firm*—Fleit, Jacobson, Cohn, Price, Holman & Stern

[57] ABSTRACT

A projectile has a nose portion and a body portion. A plurality of winged, fin-stabilized flechettes are releasably mounted in the body portion. Each flechette is mounted with its longitudinal axis at a pre-set pitch to a longitudinal axis of the projectile. In use, with the projectile moving on a projectile trajectory, each released flechette follows a respective trajectory parallel to and at a predetermined distance from the projectile trajectory. The predetermined distance for each flechette is determined by its pre-set pitch to the longitudinal axis of the projectile.

5 Claims, 2 Drawing Sheets

PROJECTILE

BACKGROUND OF THE INVENTION

1. Field of the Invention

This invention relates to projectiles and in particular to projectiles carrying fin-stabilised flechettes.

2. Description of the Prior Art

A fin-stabilised flechette is a dart-like projectile used to penetrate a target. A flechette, as disclosed in e.g. U.S. Pat No. 3,954,060 (Haag et al), may be formed as a small metal element having a pointed end and a finned rearward end for stabilising the flechette with the pointed end disposed forwardly in flight.

Projectiles which dispense a plurality of flechettes are well-known. Typically, the flechettes are arranged around and mounted on a central core of the projectile. When proximity to a target is detected, the flechettes are dispersed by explosive means and travel outwardly as well as in the forward direction, diverging away from the trajectory on which the projectile is moving. This type of projectile is suitable where there are multiple targets or where the flechettes can be dispersed close to the target.

Alternatively, as disclosed in e.g. U.S. 3,954,060, the flechettes may be disposed in tiers separated by annular spacers within a casing portion. The projectile spins in flight. At a preselected time in the flight of the projectile, the casing portion is dispersed by explosive means. The centrifugal force developed by the spin of the projectile causes the annular spacers to break up, thereby releasing the flechettes which themselves move laterally outwardly under the centrifugal action of the spinning projectile to be dispersed in a generally conical pattern as individual fragments. The dispersion pattern of the flechettes may be adjusted for optimum effectiveness by suitable correlation of the forward velocity of the projectile to its velocity of spin.

Such known projectiles are however not suitable for intercepting a target having a very high velocity, such as a missile warhead re-entering the atmosphere, when the relative velocity of the target and projectile could be Mach 15–20. With such high relative velocities, proximity fuses do not operate sufficiently rapidly or accurately for the flechettes to intercept the target. If, however, the flechettes were dispersed earlier, at some pre-selected time, they would diverge too much from the projectile trajectory to be effective. Even when the flechettes do align themselves parallel to the projectile trajectory due to their fin-stabilisation, it is difficult to pre-determine the distance from the projectile trajectory at which this will happen.

SUMMARY OF THE INVENTION

It is an object of the present invention to provide a projectile for carrying flechettes which at least alleviates some of the difficulties outlined hereinbefore.

According to the present invention there is provided a projectile having a nose portion and a body portion, said projectile comprising a plurality of winged, fin-stabilised flechettes releasably mounted in said body portion wherein each flechette is mounted with its longitudinal axis at a pre-set pitch to a longitudinal axis of said projectile, whereby, in use, with the projectile moving on a projectile trajectory, each released flechette follows a respective trajectory parallel to and at a predetermined distance from said projectile trajectory, said predetermined distance being determined by said pre-set pitch.

Because each flechette is provided with lifting surfaces and is fin-stabilised, when released from the projectile, after initially diverging away from the projectile trajectory, it stabilises to follow a trajectory parallel to and at a predetermined distance from the projectile trajectory. This predetermined distance is determined by the wing and fin characteristics of the flechette, by its velocity which is a function of the projectile velocity and by the pitch to the longitudinal axis of the projectile at which the flechette is mounted.

Preferably said plurality of flechettes comprises more than one group of flechettes, the flechettes of each group being mounted at a respective axial position, said pre-set pitch being constant for flechettes of each respective group.

The sequence of events when a projectile is fired is as follows:

(a) detect target and evaluate its trajectory;

(b) align the projectile trajectory on a reciprocal course with the target trajectory;

(c) release cover panels enclosing the body portion of the projectile;

(d) release the flechettes group by group to provide groups of flechettes flying to and at respective distances from the projectile trajectory.

This preferred aspect of the invention accordingly provides flechettes following trajectories at more than one predetermined distance from the projectile trajectory to increase the likelihood of the target being intercepted.

Preferably said predetermined distance is largest for the group mounted at an axial position nearest said nose portion.

Preferably said plurality of flechettes is mounted on and circumjacent a central longitudinal core in said body portion.

BRIEF DESCRIPTION OF THE DRAWING

An embodiment of the invention will now be described, by way of example and with reference to the accompanying drawings, in which.

DESCRIPTION OF THE PREFERRED EMBODIMENTS

Figure 1:
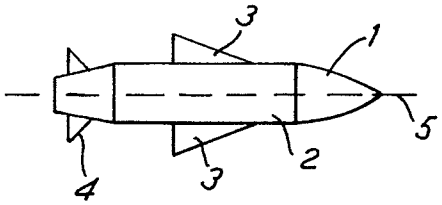
FIG. 1 shows a flechette.

FIG. 1 shows a typical flechette which comprises a soft steel nose 1, a hard tungsten centre portion 2 which penetrates the target, wings 3 and fins 4.

Figure 2:
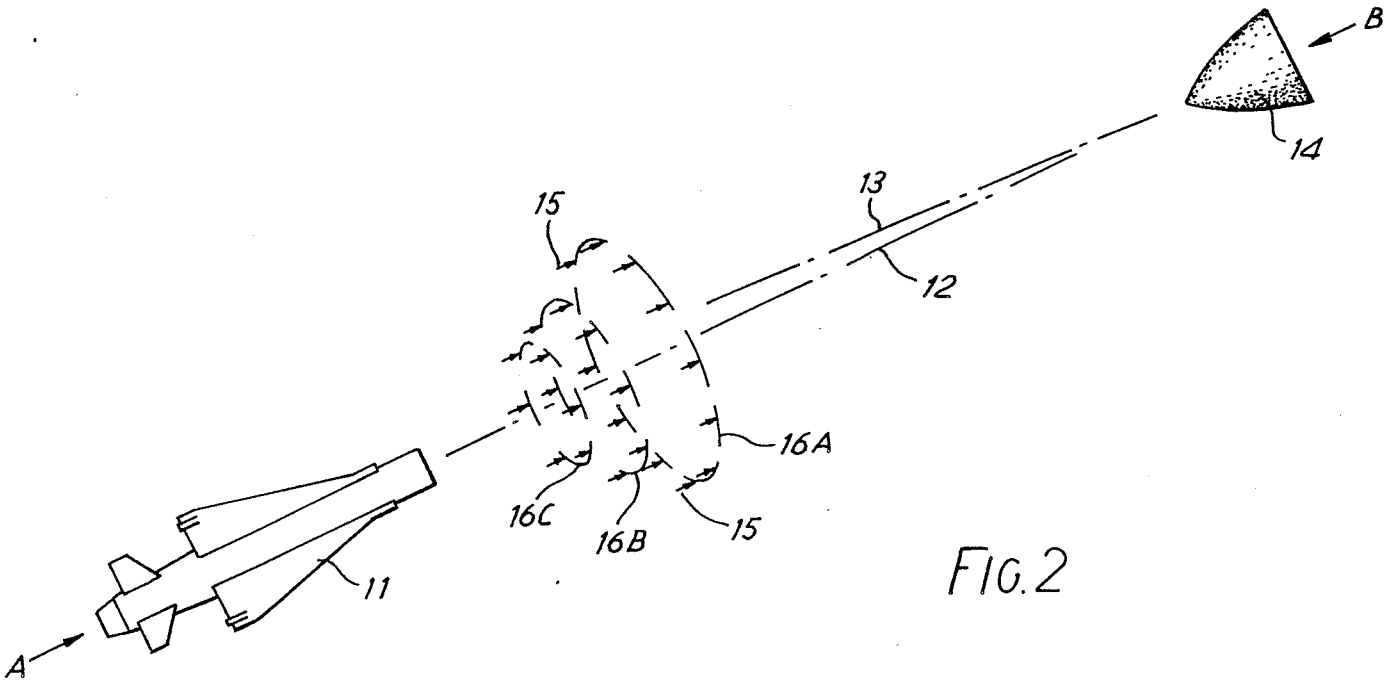
FIG. 2 shows a projectile and target with flechettes released from the projectile in accordance with the invention.

FIG. 2 shows a projectile 11 moving in the direction indicated by the arrow A on a trajectory 12 which is closely aligned with the trajectory 13 of a target 14, such as a re-entry vehicle, moving in the direction indicated by the arrow B. The projectile 11 is shown schematically, without its nose and body portions, for ease of illustration. Flechettes, shown schematically at 15, released from the projectile 11 have trajectories which pass through the circumferences of three co-axial circles 16A, 16B, 16C. The front circle 16A has the largest diameter and the back circle 16C has the smallest diameter. This arrangement increases the probability that at least one of the flechettes will intercept the target 4.

Figure 3:
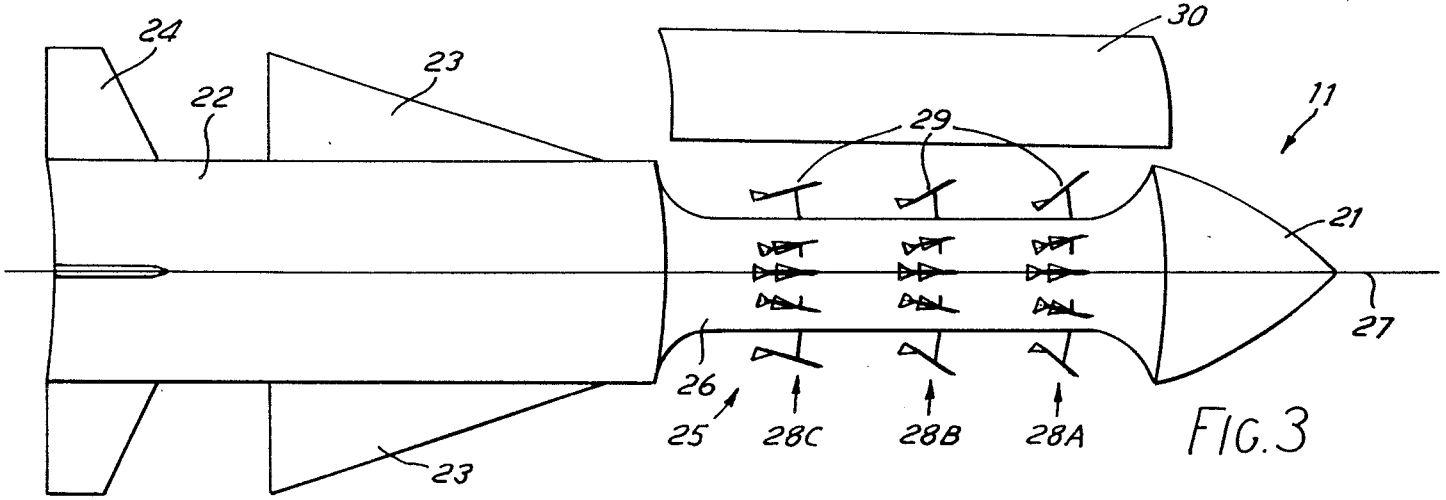
FIG. 3 shows a projectile in accordance with the invention with its cover panels displaced.

As shown in FIG. 3, the projectile 11 has a nose section 21 and a back portion 22 carrying stabilising fins 23 and a tail 24. A body portion 25, between the nose section 21 and the back portion 22, comprises a cylindrical core 26 along the longitudinal axis 27 of the projectile on which is mounted three groups 28A, 28B, 28C of flechettes 29. Cover panels, of which one is shown displaced at 30, enclose the body portion 25 until the flechettes 29 are to be released.

Each group of flechettes 28A, 28B, 28C is mounted at a respective axial position, the flechettes of each group being mounted with their longitudinal axes (designated 5 in the flechette of FIG. 1) at the same pitch to the projectile axis 27. The front group of flechettes 28A, nearest the nose section 21, is mounted with the axis of each flechette 5 at the largest pitch to the projectile axis 27, so that when the flechettes are released from the projectile 11 they form the largest circle 16A (as shown in FIG. 2). The flechettes in the back group 27C are mounted with their axes 5 at the smallest pitch so as to form the smallest circle 16C (as shown in FIG. 2). When a flechette 28 is released from the core 26 of the body portion 25, it diverges away from the projectile trajectory 12 until it is stabilised by the wings and fins with its direction of flight parallel to the projectile trajectory.

Figure 4:
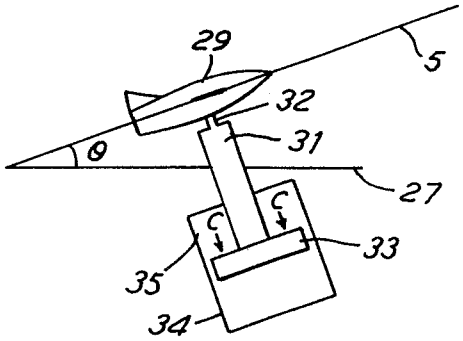
FIG. 4 shows a release mechanism to release the flechettes in the projectile.

A mechanism for releasing a flechette 29 is shown in FIG. 4. The flechette 29 is supported by a rod 31 having a thin section 32 of low mechanical strength at a convenient position along the rod. At the end remote from the flechette 29, the rod 31 is terminated by a portion 33 of increased diameter forming a piston in a gas chamber 34. When a detonater 35 is operated the gas 36 above the piston 33 expands and forces the rod 31 suddenly downwards as shown by the arrows C. The thin section 32 then breaks releasing the flechette 29. FIG. 4 also shows the pitch of the flechette axis 5 to the projectile axis 27 indicated by the symbol $\theta$.

By releasing the flechettes and allowing them to lift off the projectile without any additional lateral force, continuous divergent trajectories are avoided. After stabilising, the flechettes fly parallel to and at predetermined distances from the projectile trajectory which is aligned with the target trajectory. The present invention therefore allows the flechettes to be arranged on a collision course with a very high velocity target well before the collision would occur and thus avoids the problem of proximity fuses being much too slow.

Further control of the flechette dispersion pattern could be obtained by having moveable, pre-programmed or otherwise controlled tail surfaces on the flechettes.

I claim:

1. A projectile having a nose portion and a body portion, said projectile comprising a plurality of winged, fin-stabilised flechettes mounted in said body portion wherein each flechette is mounted with its longitudinal axis at a pre-set pitch to a longitudinal axis of said projectile, the projectile further comprising means for releasing each flechette, the releasing means allowing each flechette to lift off the projectile without any additional lateral force, whereby, in use, with the projectile moving on a projectile trajectory, each released flechette flows a respective trajectory parallel to and at a predetermined distance from said projectile trajectory, said predetermined distance being determined by said pre-set pitch.

2. A projectile according to claim 1 wherein said plurality of flechettes comprises more than one group of flechettes, the flechettes of each group being mounted at a respective axial position, said pre-set pitch being constant for flechettes of each respective group.

3. A projectile according to claim 2 wherein flechettes in a group mounted at an axial position nearest said nose portion have a pre-set pitch with is larger than the pre-set pitch for flechettes in a group mounted at an axial position further from said nose portion.

4. A projectile according to claim 1 wherein said plurality of flechettes is mounted on and circumjacent a central longitudinal core in said body portion.

5. A projectile according to claim 3 wherein the pre-set pitch for flechettes of a respective group increases with distance of the axial position of said respective group from the nose portion.

* * * * *